US009353535B2

(12) United States Patent
Borchardt

(10) Patent No.: US 9,353,535 B2
(45) **Date of Patent: *May 31, 2016**

(54) SPACE SAVING ANCHOR POINT FOR A CONCRETE STRUCTURE

(71) Applicant: Mark A Borchardt, Seattle, WA (US)

(72) Inventor: Mark A Borchardt, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/554,620

(22) Filed: Nov. 26, 2014

(65) Prior Publication Data

US 2015/0368919 A1 Dec. 24, 2015

Related U.S. Application Data

(63) Continuation-in-part of application No. 14/309,372, filed on Jun. 19, 2014, now Pat. No. 9,238,155.

(51) Int. Cl.
*E04B 1/38* (2006.01)
*E04G 21/32* (2006.01)
*E04B 1/41* (2006.01)

(52) U.S. Cl.
CPC ..... *E04G 21/3223* (2013.01); *E04B 1/415* (2013.01)

(58) Field of Classification Search
CPC ..... E04B 5/00; E04B 1/40; E04B 1/4178; E04B 1/38; E04B 2/30; E04B 1/4121; E04B 1/41; E04G 21/142; E04G 15/04; E04G 21/32; B66C 1/666; B28B 23/005
USPC ..... 52/125.4, 125.5, 125.6, 122.1, 125.1, 52/125.3
See application file for complete search history.

(56) References Cited

U.S. PATENT DOCUMENTS 1,037,142 A * 8/1912 Hazen ..... E04B 1/4135 52/698
1,244,034 A * 10/1917 Cummings ..... E04B 1/4142 52/706
1,285,202 A * 11/1918 Jaques et al. ..... E04B 1/4121 248/343
3,078,621 A * 2/1963 Hinds ..... E04G 21/142 206/321
3,550,343 A * 12/1970 Buske ..... E04B 1/4142 410/112
3,821,338 A * 6/1974 Faust ..... E04G 15/061 248/524
3,873,147 A * 3/1975 Annable ..... B66C 1/666 294/89
4,173,856 A * 11/1979 Fricker ..... E04G 21/142 248/499
4,318,525 A * 3/1982 Welch ..... F16M 13/027 248/228.7
4,512,121 A * 4/1985 Carydias ..... E04G 21/142 52/125.2

(Continued)

*Primary Examiner* — Joshua J Michener
*Assistant Examiner* — Keith Minter
(74) *Attorney, Agent, or Firm* — Dean A Craine; Marisa C Whitaker

(57) ABSTRACT

A space saving anchor point for a concrete deck or column. The anchor point includes an elongated receiver box attached to the inside surface of a form used to construct a concrete structure that becomes embedded the concrete deck. The elongated box is a partially enclosed structure with a lower opening that communicates with an interior cavity. The elongated box includes optional flange surfaces that attached to the inside surface of a form used to construct the concrete deck. Extending transversely through the interior cavity is a rod with its opposite ends that extend laterally from the sides of the elongated box and become covered with concrete. Attached to the portion of the rod located inside the interior cavity is an elongated connector plate. The connector plate is assembled on the rod and is configured to rotate around the rod and move longitudinally inward inside the interior cavity to hidden position or moved outward from the interior cavity partially exposing the plates' second opening. The second opening may connect to a suitable snap hook or clip used by a construction worker when working near a leading edge fall hazard.

8 Claims, 6 Drawing Sheets

(56) References Cited

U.S. PATENT DOCUMENTS 4,702,045 A * 10/1987 Fricker ..... E04G 21/142 52/125.4
5,553,685 A * 9/1996 Cook ..... A62B 35/0068 182/3
5,625,993 A * 5/1997 Kelly ..... E04B 1/4107 52/506.05
5,666,768 A * 9/1997 Gavin ..... E02D 29/12 16/438
5,699,639 A * 12/1997 Fernandez ..... E04B 7/045 52/295
7,254,926 B2 * 8/2007 Eldeen ..... E04B 1/003 52/650.3
7,654,057 B2 * 2/2010 Zambelli ..... E04B 1/4107 411/82
2005/0257446 A1 * 11/2005 Wolner ..... A62B 35/0068 52/127.1
2006/0060439 A1 * 3/2006 Shirokoshi ..... F16M 11/10 188/382
2006/0242924 A1 * 11/2006 Kwon ..... E04B 1/415 52/704
2007/0039258 A1 * 2/2007 Walker, III ..... E04B 2/96 52/235
2008/0042029 A1 * 2/2008 Reeves ..... E04G 21/3261 248/231.91
2011/0309041 A1 * 12/2011 Amadio ..... F16M 11/10 211/26
2013/0185906 A1 * 7/2013 Nichols, Jr. ..... A62B 35/0068 24/703.1
2014/0251724 A1 * 9/2014 Nichols, Jr. ..... A62B 35/0068 182/3
2015/0196785 A1 * 7/2015 Borchardt ..... E04B 5/00 52/700
2015/0368919 A1 * 12/2015 Borchardt ..... E04B 1/415 52/706

* cited by examiner

SPACE SAVING ANCHOR POINT FOR A CONCRETE STRUCTURE

This is a continuation in part application based on U.S. utility patent application Ser. No. 14/309372 filed on Jun. 19, 2014.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to apparatus, systems and methods for constructing fall prevention anchor points in a concrete ceiling.

2. Description of the Related Art

Many buildings have floors made of concrete slabs or decks manufactured by pouring wet concrete into wood forms. After the concrete has dried and cured, the wood forms are removed exposing the exterior surfaces of the concrete deck. When the bottom surface of the concrete deck acts as the ceiling for a lower floor, HVAC duct work, plumbing and electrical conduits, and insulation materials are sometimes attached to the bottom surface.

Federal, state and local regulations require workers use or wear fall restraining or fall arresting equipment when working at elevations greater than 6 feet above a floor or when working near the open leading edge of a building. Such equipment typically includes lanyards attached at one end to a harness or vest worn by the worker. The opposite end of the lanyard is attached to a rigid anchor point.

When working on the floor of a building with open leading edges, workers must wear fall arresting equipment at all times. Because the workers must move on the floor, the fall arresting equipment must allow the worker to move freely over the floor.

What is needed is an inexpensive, easy to install anchor point that attaches to a fall resistant lanyard worn by a worker that is embedded into a concrete deck structure which forms the ceiling for a lower floor. What is also needed is an anchor point that is partially exposed and readily visible to workers working on the lower floor.

In some instances, the concrete structure is relatively small or contains interior structural rebar members or duct work that limit the size of the anchor point that can be installed in the concrete structure.

A compact, space saving anchor point that meets all of the above stated needs would be desirable.

SUMMARY OF THE INVENTION

A concrete deck anchor point is disclosed that includes a plate connector that drops down through a lower slot opening formed on a narrow, partially enclosed receiver box assembled into the bottom surface of a concrete deck that forms the ceiling for a lower floor in a building. The receiver box is oriented so the lower slot opening is flush with the bottom surface of the concrete deck and exposed when the form used to construct the concrete deck is removed.

The receiver box is a hollow, five-sided elongated box with two long walls, two end walls, and a top panel. Formed on the receiver box opposite the top panel is a rectangular slot opening that leads to a narrow, upward extending interior cavity formed inside the receiver box. Disposed around the slot opening and perpendicular aligned with the box's side walls and end walls is at least one laterally extending mounting surfaces. Formed on the mounting surface is at least one nail hole or slot.

During assembly, the receiver box is mounted with its slot opening facing downward against the inside surface of a planar wood form used to create the bottom surface of the concrete deck. The receiver box is also oriented so its mounting surface is positioned adjacent to the inside surface of the wood form. A nail or screw is inserted into the hole or slots to hold the receiver box in place on the wood form when wet concrete is poured over the wood form and around the receiver box. When the concrete is cured, the wood form is removed and the receiver box with a slot opening facing downward is embedded into the concrete deck. When the form is removed, the slot opening is exposed.

Formed on the receiver box's two opposite long walls are two rod openings configured to receive a rod extending transversely through the interior cavity formed in the receiver box. The ends of the rod extend laterally from the long side walls and become embedded in the concrete when the concrete deck is poured.

Connected to the portion of the rod that extends into the interior cavity is a thin connector plate. In one embodiment, the connector plate includes two holes formed on its opposite ends. During assembly, the connector plate is inserted into the interior cavity so the rod extends through one hole formed on the connector plate to permanently connect the connector plate to the rod. Because the two holes are on opposite ends of the connector plate, the connector plate freely rotates around the rod and the opposite ends extends downward from the slot opening after the wood form is removed. The lengths of the receiver box and the connector plate are sufficient so the connector plate is disposed inside the receiver box when the receiver box is attached to the inside surface of the wood form. When the wood form is removed, the connector plate automatically extends downward through the slot opening and is visible. A suitable snap hook or D-ring connector connected to a fall resistant lanyard or safety strap attached to a safety harness or vest worn by the worker. The lanyard or safety strap and harness or vests are fall resistant structures designed to prevent injuries from falls.

A third embodiment of the anchor point is a compact, space saving version that includes a rotating connector plate that selectively moves longitudinally inside a compact, narrow elongated receiver box. Like the previous embodiments, the connector plate is designed to fit entirely inside the receiver box when longitudinally aligned with the receiver box. The receiver box is aligned on the concrete structure so its longitudinal axis is perpendicular to the outside surface of the concrete structure. The first opening on the connector plate is oval thereby enabling the connector plate to slide longitudinally inside the receiver box and exposed the connector plate's second opening. Formed on each side wall on the elongated receiver box is a hole through which a connecting rod extends. During construction of the concrete structure the side walls of the receiver box and the exposed ends of the connecting rod are embedded in concrete . Optional washer may be attached to the connecting rod which hold the connecting rod in place on the elongated box. The receiver box may include optional flange surfaces on four opposite sides that enable the receiver box to be attached to the inside surface of a wood form used to construct the concrete structure. The flange surfaces can also act as depth guides for positioning the receiver box in the form.

In another method to use the anchor points, at least two anchor points are assembled on the bottom surface of a concrete deck and a cable attached at its opposite ends attaches at its opposite ends to the two connector plates. A suitable snap hook or D-ring connector configured to slide over the cable is attached to a fall resistant lanyard or safety strap connected to a worker that enables the worker to move over the floor and longitudinally under the cable.

DESCRIPTION OF THE PREFERRED EMBODIMENT(S)

Figure 1:
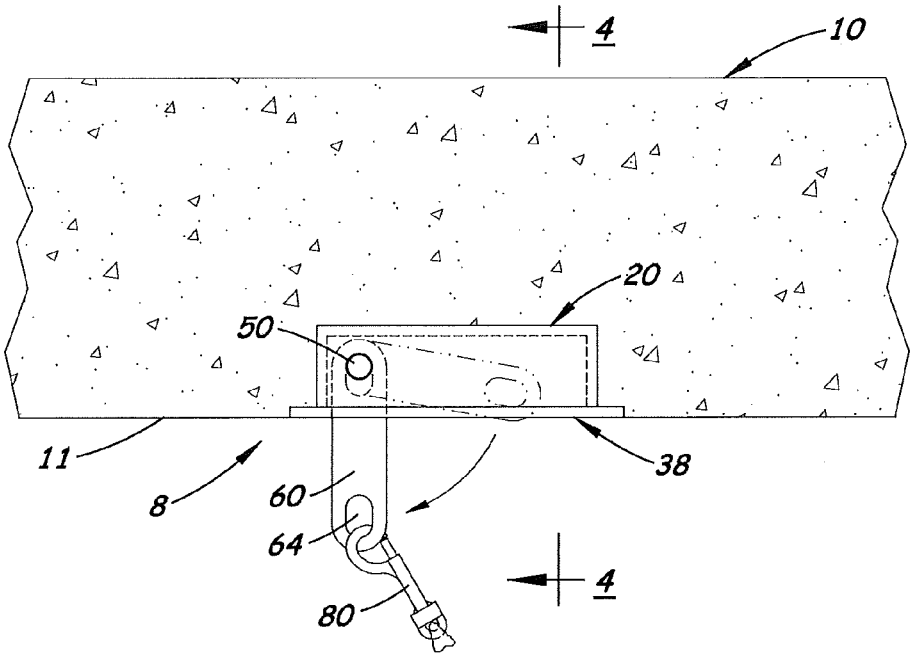
FIG. 1 is a sectional front elevational view of a section of a concrete deck with the tie off anchor system imbedded into the ceiling of the concrete deck and showing the connector plate rotated downward so its lower end extends through the slot opening and act as an anchor point for a safety strap
Figure 2:
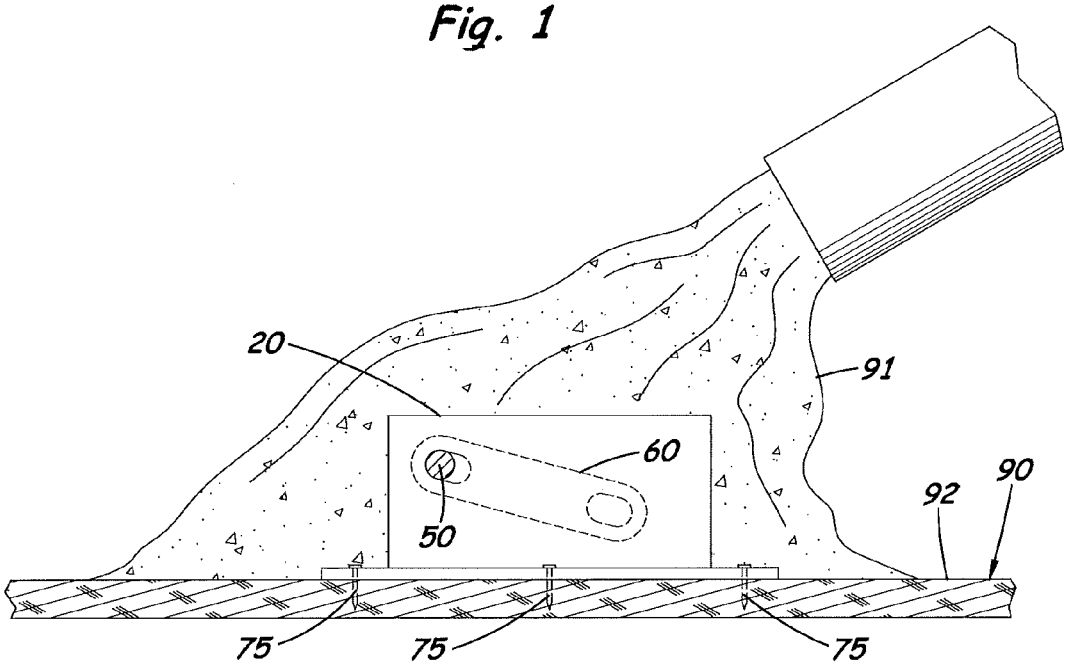
FIG. 2 is an illustration showing the anchor point assembled on the form used to construct a concrete deck.

A fall protection tie-off anchor point 8 created on a concrete deck 10 that includes a receiver box 20 oriented so the lower slot opening 38 is flush with the bottom surface 11 of a finished concrete deck 10, which acts as a ceiling for a floor located below the deck 10, and exposed when the form 90 used to construct the concrete deck 10 is removed.

Figure 3:
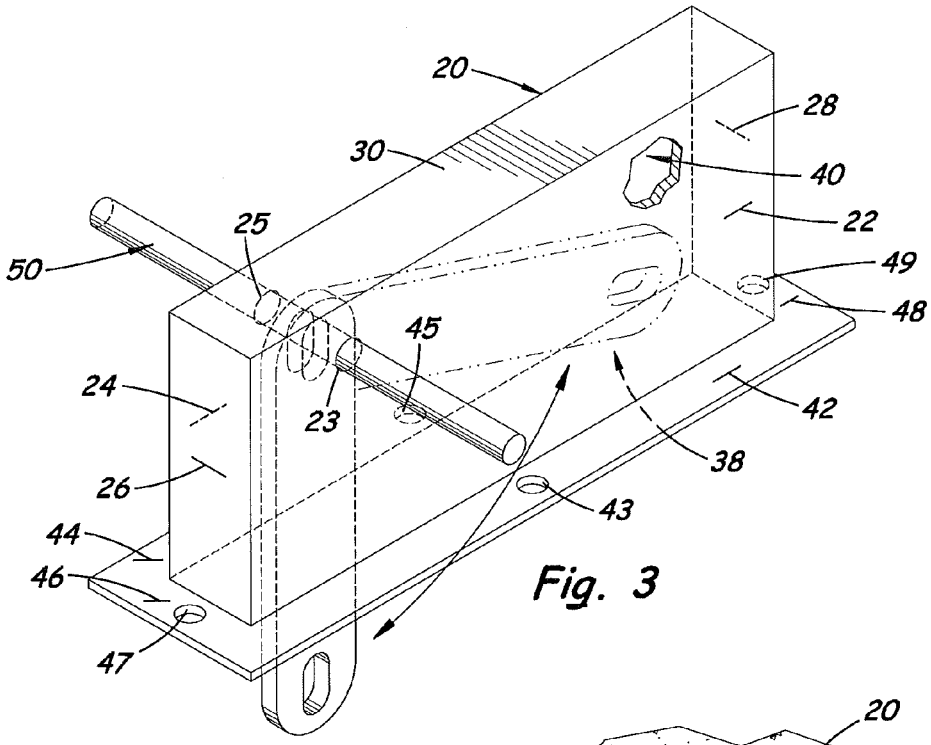
FIG. 3 is a perspective view of the anchor point.
Figure 5:
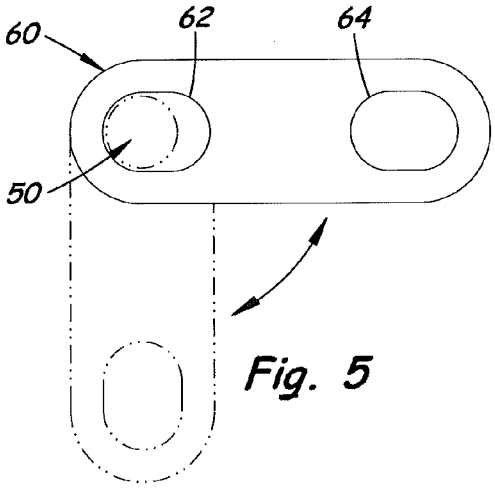
FIG. 5 is a side elevational view of the connector plate.
Figure 4:
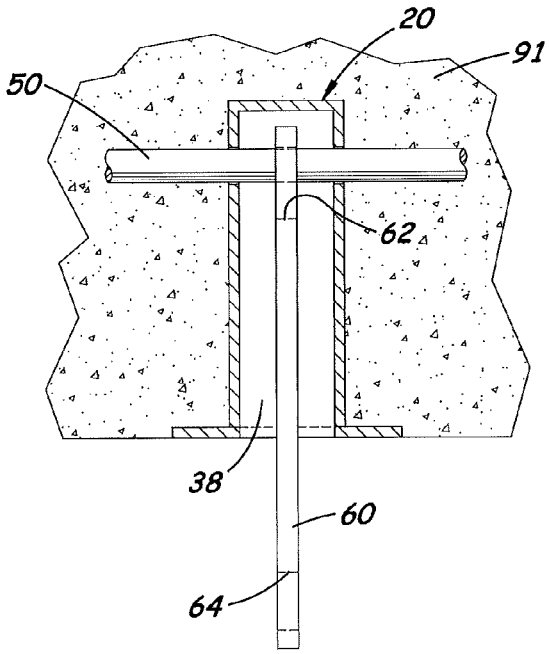
FIG. 4 is a sectional, end elevational view the anchor point embedded imbedded in a concrete deck taken along line 4-4 in FIG. 1.

As shown in FIGS. 3 and 4, the receiver box 20 is a hollow, five-sided elongated box with two long walls 22, 24, two end walls 26, 28, and a top panel 30. Formed on the receiver box 20 opposite the top panel 30 is a rectangular slot opening 38 that leads to a narrow interior cavity 40. Disposed around the slot opening 38 and perpendicular aligned with the box's side walls 22, 24 and end walls 26, 28 are four laterally extending mounting flange surfaces 42, 44, 46, and 48, respectively. Formed on each flange surface 42, 44, 46, and 48 is at least one nail hole 43, 45, 47, and 49, respectively. During assembly, a suitable nails 78 are inserted through the holes 43, 45, 47, and 49 to attach the receiver box 20 to the inside surface 92 of the form 90.

Formed on the receiver box's two opposite long walls 22, 24 are two rod openings 23, 25 configured to receive a rod 50 extending transversely through the inner cavity 40 formed in the receiver box 12. The ends of the rods 50 extend laterally and are embedded in the concrete 91 as shown in FIG. 4.

The anchor point 8 also includes a connector plate 60 that connects to the portion of the rod 50 that extends into the inner cavity 40. In one embodiment, the connector plate 60 is a flat, elongated plate with two elongated, oval-shaped holes 62, 64 formed on its opposite ends. During assembly, the connector plate 60 is inserted into the inner cavity 40 so the rod 50 extends through the top hole 62 to connect the connector plate 60 to the rod 50. The connector plate 60 can rotate freely around the rod 50 and is sufficient in length so the opposite end of the connector plate 60 extends through the slot opening 38 when the receiver box 20 when the wood form 90 is removed. When the form 90 is removed, the connector plate 60 automatically rotates so the lower elongated hole 64 on the connector plate 60 is exposed. A worker may connect to a suitable D-ring connector 80 to the lower hole 64 when working on or under the ceiling.

Figure 6:
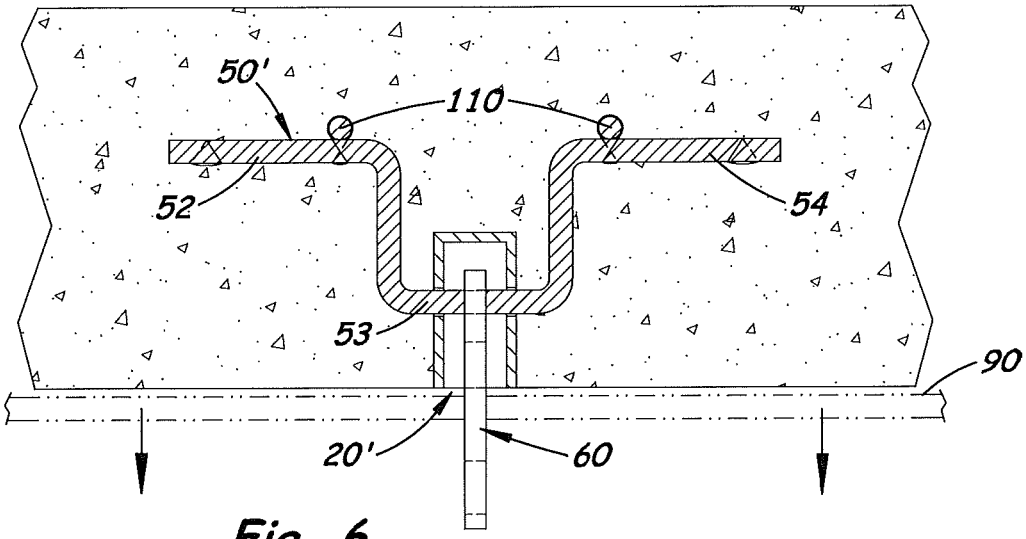
FIG. 6 is a second embodiment of the anchor point that uses a U-shaped rod.

FIG. 6 is a second embodiment of the anchor point 8 that uses a U-shaped rod 50' in place of a straight rod 50. The rod 50' includes two upper arm sections 52, 54 that extend upward from the receiver box 20' and attach to the structural rebar members 110 assembled in the deck above the receiver box 20'. The receiver box 20' is identical to the receiver box 20 accept for the absence of flange members. During assembly, the receiver box 20' is positioned over the wood form and the two upper arm sections 52, 54 are then tied to the rebar members 110 to hold the receiver box 20' in place.

In the embodiment shown in the Figs., the receiver box 20, 20' measures approximately 8 inches is length, 3 inches in height, and ¾ inches in width. The side walls, end walls and top panel are made of plastic approximately ⅛ inches thick. The two rod openings 23, 25 are approximately 11/16 inches in diameter and the rod 50 is approximately ½ inch in diameter and 8 to 16 inches in length. On receiver box 20, the mounting surfaces 42, 44, 46, and 48, includes at least one nail or screw hole 43, 45, 47, and 49, respectively, that measure approximately ¼ inches in diameter. It should be understood that receiver box 20, 20' may include one or more mounting surfaces 42, 44, 46, and 48.

The connector plate 60 is a flat thin metal or other composite material meeting the OSHA 5000 lb to 10,000 lb. requirement for anchorage points and varies in length depending on the required structural thickness of the concrete deck 10 it is being installed in. The connector plate 60 measures approximately 7 to 9 inches in length, 2 inches in width and ¼ inch thick. The elongated holes 62 and 64 measure approximately 1¾ inches in length, and 1¼ inches in width.

As stated above, the rod 50 and connector plate 60 are assembled on the receiver box 20. The connector plate 60 is then rotated inside the interior cavity 40 and the mounting surfaces 42, 44, 46, and 48 are then positioned at a desired location over the inside surface 92 of the form 90. Nails 75 are then inserted into the nail holes 43, 45, 47, and 49 to hold the receiver box 20 on the form 90. Wet concrete 91 is then poured over the form 90 and over the receiver box 20 and the exposed ends of the rod 50. After the concrete 91 has cured, the form 90 is then removed thereby exposing the slot opening 38 and the connection plate 60. Gravity causes the connector plate 60 to rotate around the rod 50 so the lower elongated hole 64 is exposed and may be accessed by a worker.

Figure 7:
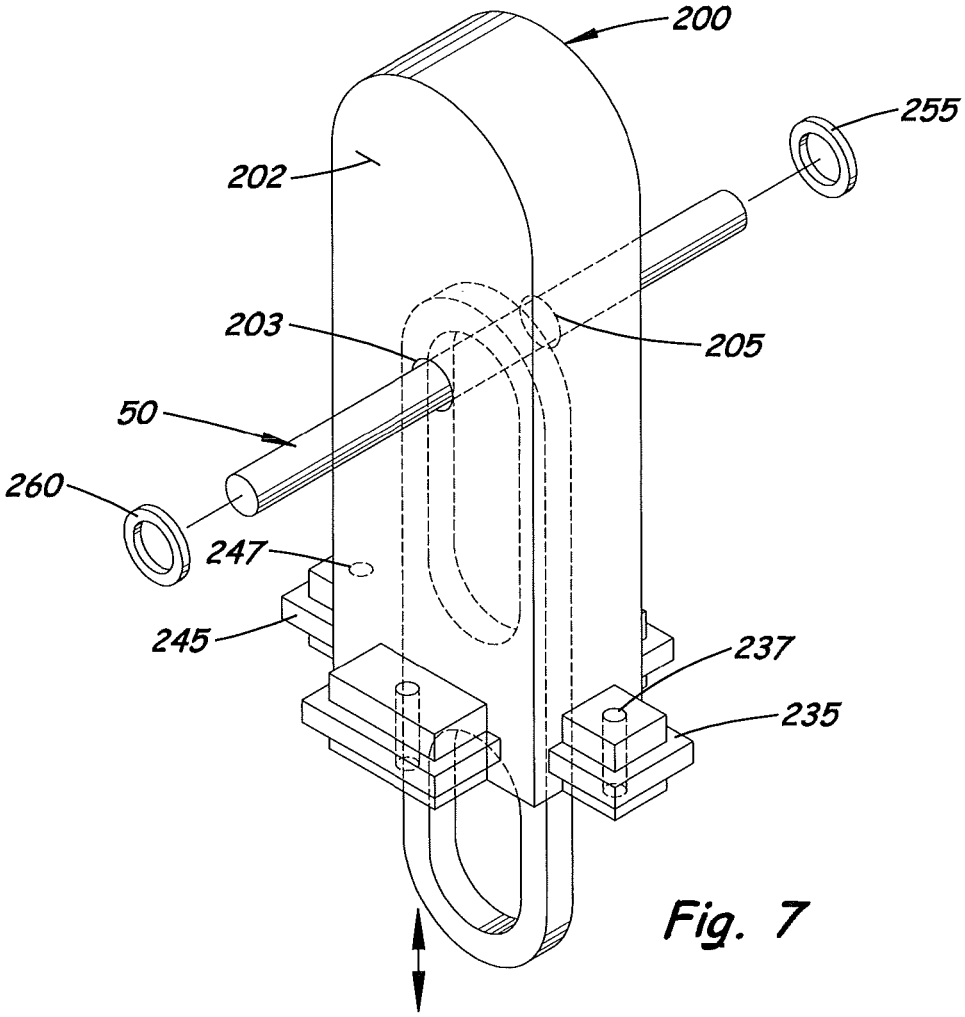
FIG. 7 is a third embodiment of the anchor point that uses a narrow elongated box with an interior cavity that is perpendicularly aligned with the box's open mounting surface in which a transversely aligned rod that engages a thin connector plate that selectively moves from a hidden, inward position to an outward exposed position from the interior cavity when needed.
Figure 10:
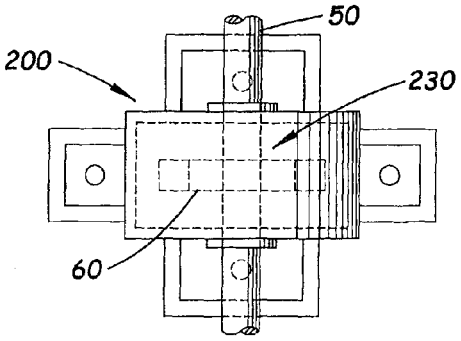
FIG. 10 is a top plan view of the anchor point shown in FIGS. 7-9.

FIG. 7 is a third embodiment of the anchor point 8 that includes a rotating connector plate 60 that selectively moves longitudinally inside a narrow elongated receiver box 200. During use, the connector plate 60 can slide longitudinally and fit entire into the elongated receiver box 200 or it may slide longitudinally from the elongated receiver box 200 and expose the second opening 64 formed on the connector plate 60.

The receiver box 200 includes two parallel large side walls 202, 204, two parallel small side walls 206, 208, a curved end wall 210, and an end opening 220. Formed inside the elongated box 200 is an interior cavity 230 that is perpendicularly aligned with the box's open end surface 220. Formed on each side wall 202, 204 is a hole 203, 205 through which a connecting rod 50 extends. Optional washers 250, 255 may be attached to the connecting rod 50 which hold the connecting rod 50 in place on the elongated receiver box 200.

Figure 8:
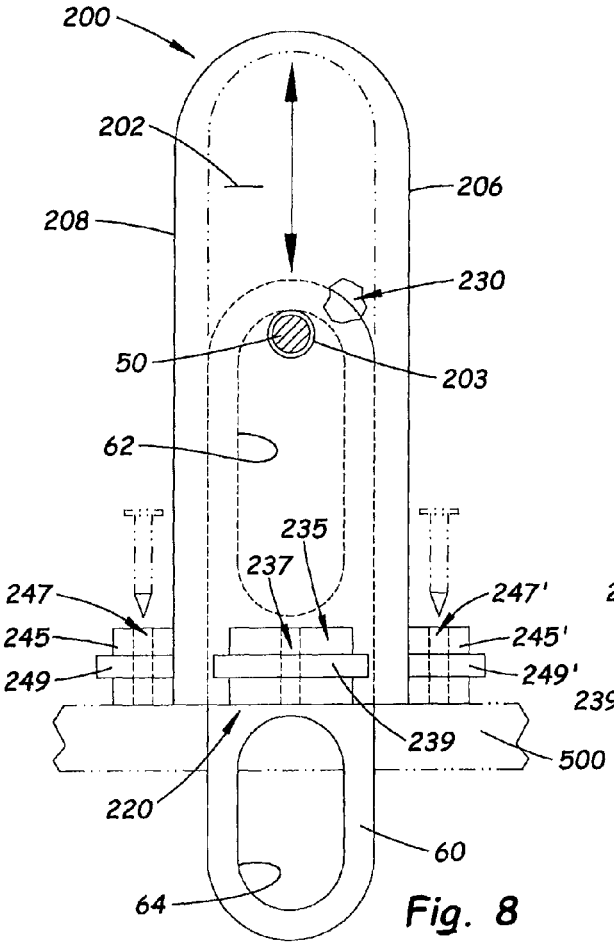
FIG. 8 is a side elevational view of the anchor point shown in FIG. 7
Figure 9:
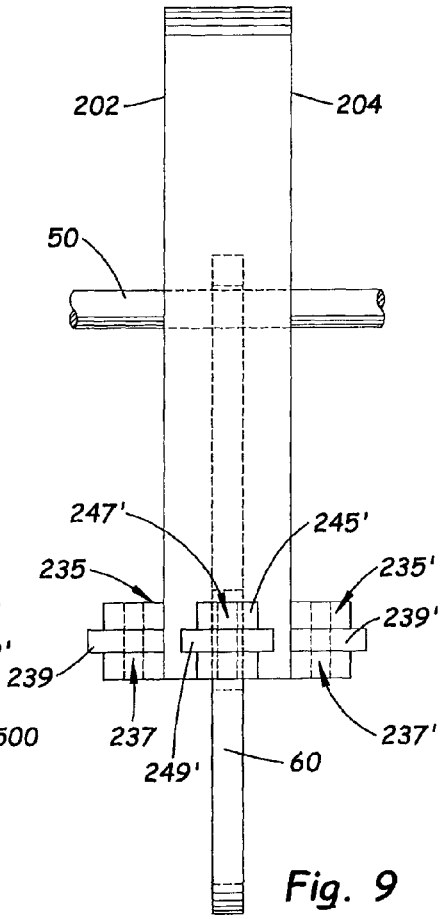
FIG. 9 is a front elevational view of the anchor point shown in FIGS. 7 and 8.

Mounted on the lower end of the elongated box near the end opening 220 on opposite side surfaces 202, 204 are four mounting flange surfaces 235, 235', 245 and 245' each with a hole 237, 237', 247, and 247', respectively, formed therein configured to receive a suitable connector (screw or nail) to attach the elongated receiver box 200 to the inside surface of a wood form 500 (see FIG. 8). Each flange surface 235, 235', 245 and 245' may include an optional lip 239, 239', 249, and 249', respectively, that extends laterally from the adjacent edge. The flange surfaces 235, 235', 245, and 245' may be used as attachment points for attaching the elongated receiver box 20 to rebar members located adjacent to the elongated receiver box 20. They may also be used as a fence or depth gauge for a form.

With this embodiment, the connector plate 60 must fit longitudinally inside the elongated receiver box 200 and, when desired, partially extend through the end opening 220. During use, the connector plate 60 may be rotated 15 to 45 degrees over the connecting rod 50. The upper hole 62 on the connecting plate 60 is oval and is sufficient in length and is located from the upper end of the connector plate 60 so that the connecting plate 50 may be forced inward to hide the connector plate 60 inside the interior cavity 230 so that an optional cover 300 (see FIG. 13) may be placed over and attached to the two flange surfaces. The cover 300 may be removed from the elongated receiver box 200 to access the connector plate 60 and pull it outward to expose the second hole 64.

Figure 11:
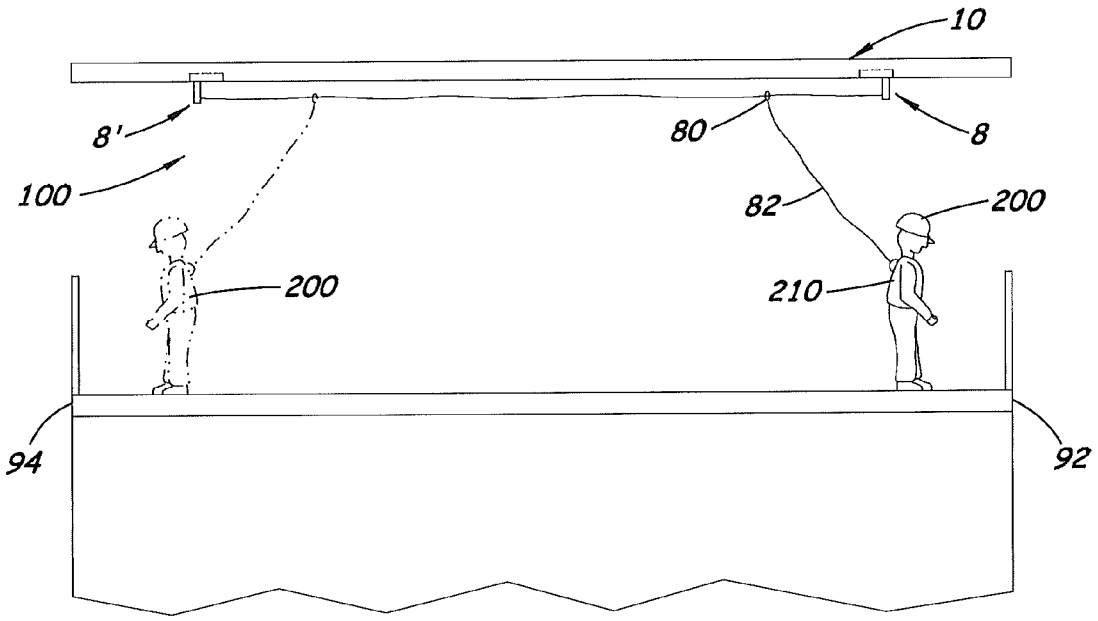
FIG. 11 is an illustration of an anchor system that includes at least two anchor points mounted on the ceiling and showing a worker on the floor of a building near the two leading edges attached to one end of a fall resistant lanyard that attaches at a higher end to cable that extends between the two anchor points.

In the third embodiment, the receiver box 200 measures approximately 7¾ inches in length, 2½ inches in width and 1¼ inches in depth. The flanges are FIG. 11 is an illustration of an anchor system 100 that includes at least two anchor points 8, 8' mounted on the ceiling and showing a worker 200 wearing a safety harness 202 attached to the lower end of a fall resistant lanyard 82 and working on the floor 92 of a building 90 near the two leading edges 94, 96. The upper end of the lanyard 82 is attached to a slide connector 80 that configured to slide freely over the cable 100.

Figure 12:
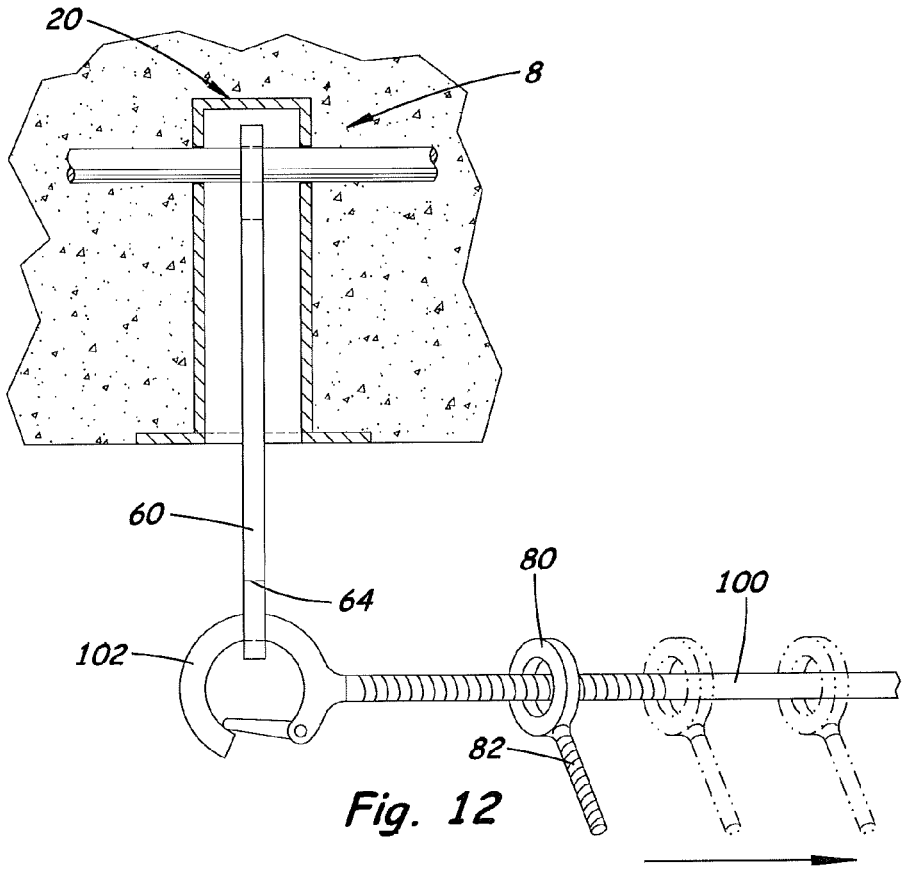
FIG. 12 is an illustration showing the connector plate extended from the receiver box and with the connector attached cable that extends laterally and showing a connector attached to a fall resistant lanyard and sliding over the cable.

FIG. 12 is an illustration showing in greater detail the connector plate 60 extended from the receiver box 20 and with the connector 102 attached cable 100 that extends laterally and showing a connector 80 attached to a fall resistant lanyard 82 and sliding over the cable 100

Figure 13:
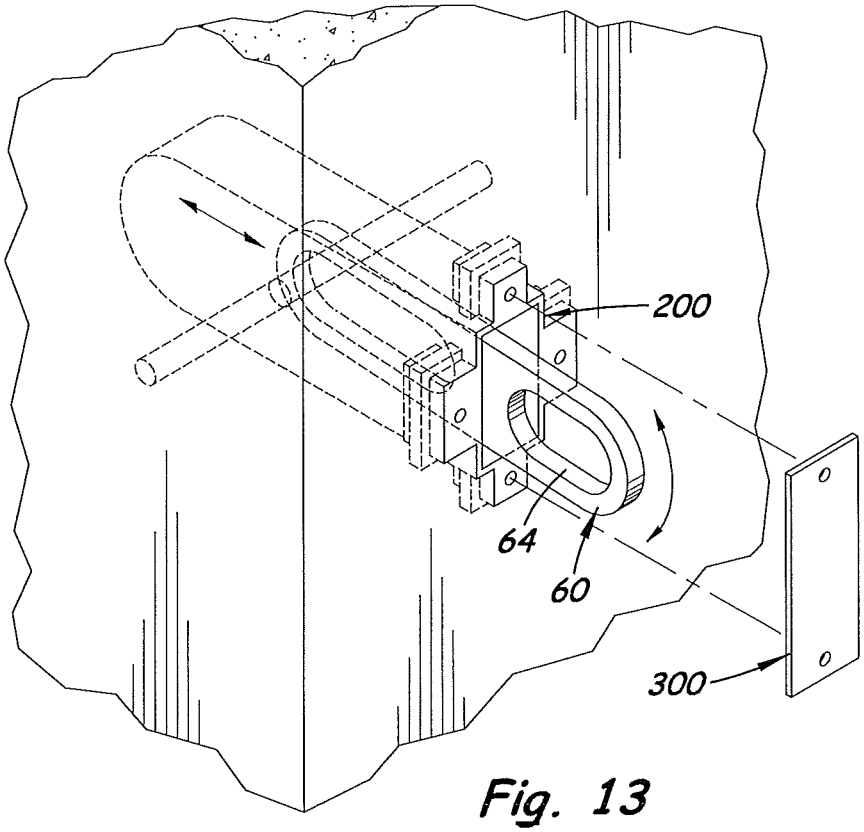
FIG. 13 is an illustration of the third embodiment of the anchor point located on a vertical column.

FIG. 13 is an illustration showing the anchor point used with the elongated box 200 mounted on a vertical column.

A method for constructing a tie-off anchor point in a concrete deck is disclosed comprising the following steps;

a. constructing a form configured to form a concrete deck, said form includes a lower horizontal or vertical surface;

b. selecting a receiver box with two long side walls, two short end walls, a top wall, a lower opening, an interior cavity, and at least one flange surface;

c. attaching said receiver box on the inside surface of said form;

d. selecting a rod and extending said rod through said long side walls on said receiver box and transversely over said interior cavity, said rod including opposite ends that extend laterally from said side walls;

e. attaching a connector plate attached a portion of said rod located inside said interior cavity; and, f. attaching said receiver box over said inside surface of said form.

An alternative method for constructing a tie-off anchor point in a concrete structure is also disclosed comprising the following steps;

a. constructing a form configured to form a concrete deck, said form includes a lower surface;

b. selecting an elongated box with two long side walls, two short end walls, a top wall, a lower opening, an interior cavity, and at least one flange surface;

c. attaching said elongated box on the inside surface of said form;

d. selecting a rod and extending said rod through said long side walls on said elongated box and transversely over said interior cavity, said rod including opposite ends that extend laterally from said side walls;

e. attaching a connector plate attached a portion of said rod located inside said interior cavity; and, f. attaching said elongated box over said inside surface of said form.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An anchor point for a concrete structure, comprising:

a. an elongated box with two long side walls, two short side walls, an end wall, an end opening opposite said end wall, and an interior cavity, mounted on one end of each said long side wall and each said side wall and adjacent to said end opening is a flange surface, each said flange surface includes an outer lip configured to be used as a fence or depth gauge for a form;

b. a rod extending transversely through said interior cavity, said rod including a center portion located inside said interior cavity and two opposite ends that extend laterally from said long side walls and are embedded into the concrete structure; and, c. an elongated connector plate attached at one end to said center portion of said rod located inside said interior cavity, said connector plate includes an oval shaped first opening configured to slide longitudinally over said rod and allow said connector plate to move between a longitudinally align position inside said elongated box to a partially extended position through said lower opening, said connector plate includes a lower hole located near an end opposite said end connected to said rod.

2. The anchor point as recited in claim 1, further including a hole formed on said flange surface configured to receive a nail or screw that attaches said flange surface to the wood form.

3. The anchor point, as recited in claim 1, wherein said rod is straight.

4. The anchor point, as recited in claim 1, wherein said rod is u-shaped with a straight intermediate member with two upward extending.

5. The anchor point, as recited in claim 3 wherein said rod is attached to rebar members located inside said concrete deck.

6. The anchor point as recited in claim 1, wherein said elongated box is 7 to 9 inches in length.

7. The anchor point as recited in claim 1, wherein said second hole formed on said connector plate is oval shaped.

8. A method for constructing a tie-off anchor system in a concrete structure is also disclosed comprising the following steps:

a. constructing a form configured to form a concrete deck, said form includes an inside surface;

b. selecting an elongated box with two long side walls, two short end walls, a top wall, a lower opening, an interior cavity, and at least one flange surface mounted on one end of each said long side wall and each said side wall and ad adjacent to said end opening is a flange surface, each said flange surface includes an outer lip configured to be used as a fence or depth gauge for a form;

c. attaching said flange surfaces on said elongated box to said inside surface of said form;

d. selecting a rod and extending said rod through said long side walls on said elongated box and transversely over said interior cavity, said rod including opposite ends that extend laterally from said side walls;

e. attaching a connector plate attached a portion of said rod located inside said interior cavity; and, f. attaching said elongated box to said inside surface of said form.

* * * * *